US007385316B2

(12) United States Patent
Jacobberger

(10) Patent No.: US 7,385,316 B2
(45) Date of Patent: Jun. 10, 2008

(54) SAFETY DEVICE FOR AN INDUSTRIAL BOILER COMPRISING RELAYS MOUNTED ON A PRINTED CIRCUIT BOARD

(75) Inventor: Charles Jacobberger, Storckensohn (FR)

(73) Assignee: Stein Energie Chaudieres Industrielles, Cernay (FR)

( * ) Notice: Subject to any disclaimer, the term of this patent is extended or adjusted under 35 U.S.C. 154(b) by 396 days.

(21) Appl. No.: 10/480,920

(22) PCT Filed: May 17, 2002

(86) PCT No.: PCT/FR02/01675

§ 371 (c)(1),
(2), (4) Date: Jun. 4, 2004

(87) PCT Pub. No.: WO03/001116

PCT Pub. Date: Jan. 3, 2003

(65) Prior Publication Data

US 2004/0214119 A1 Oct. 28, 2004

(30) Foreign Application Priority Data

Jun. 20, 2001 (FR) ..... 01 08095

(51) Int. Cl.
*H02H 11/00* (2006.01)

(52) U.S. Cl. ..... 307/326

(58) Field of Classification Search ..... 307/326
See application file for complete search history.

(56) References Cited

U.S. PATENT DOCUMENTS

| | | | | |
|---|---|---|---|---|
| 4,334,258 | A | 6/1982 | Seeman et al. | |
| 5,549,469 | A | 8/1996 | Wild et al. | |
| 5,655,009 | A * | 8/1997 | Arai et al. | 379/93.28 |
| 5,672,873 | A * | 9/1997 | Yamazoe | 250/339.12 |
| 5,910,837 | A * | 6/1999 | Gimzewski | 356/213 |
| 6,584,560 | B1 * | 6/2003 | Kroun et al. | 713/2 |
| 6,681,011 | B1 * | 1/2004 | Staver et al. | 379/387.01 |
| 2002/0101231 | A1 * | 8/2002 | Staats | 324/126 |
| 2002/0135414 | A1 * | 9/2002 | McCall et al. | 327/307 |

FOREIGN PATENT DOCUMENTS

| | | |
|---|---|---|
| EP | 0 751 350 A | 1/1997 |
| FR | 2 243 622 A | 4/1975 |

* cited by examiner

*Primary Examiner*—Michael J Sherry
*Assistant Examiner*—Dru Parries
(74) *Attorney, Agent, or Firm*—Sughrue Mion, PLLC

(57) ABSTRACT

A safety device for an industrial boiler (CHA) including relays ($RE_n$) which are connected to form an electromechanical safety chain (CH1). Each relay ($RE_n$) is mounted on a printed circuit board ($CI_A$, $CI_B$, $CI_C$, CIP). As a result of the arrangement, the relays can be mounted in a compact box that may be sealed so that it is impossible for an operator to access a relay in order to block it.

5 Claims, 2 Drawing Sheets

SAFETY DEVICE FOR AN INDUSTRIAL BOILER COMPRISING RELAYS MOUNTED ON A PRINTED CIRCUIT BOARD

BACKGROUND OF THE INVENTION

The invention relates to a safety device for an industrial boiler, the device comprising electromechanical relays connected to form an electromechanical safety chain.

The invention applies in particular to industrial boilers comprising a gas burner for producing steam or superheated water, for example. These boilers are fitted with a safety device that is located between one or more sensors and one or more actuators mounted on the boiler and triggers shutting down of the boiler via the actuators when at least one sensor detects a malfunction of the boiler. The fault may be an excess pressure, a low water level, or a problem with the burner flame.

A safety device of the above kind is more particularly adapted to open a power supply circuit of the actuators on detection of a fault by a sensor. The actuators, which may be solenoid valves, for example, are designed to trigger shutting down of the boiler as soon as they are no longer supplied with power by the power supply circuit. Each sensor supplies an alternating electrical current at 230 volts to the safety device if the boiler is operating normally and does not supply this current if a fault is detected. This kind of arrangement provides what is known as "positive" safety, in that interruption of the electrical power supply triggers shutting down of the boiler.

In the above safety device, there corresponds to each sensor a relay that is live when it receives the current supplied by the corresponding sensor, and the contacts of the relays corresponding to the various sensors are connected in series, for example, to form an electromechanical safety chain in the form of hardwired logic. The electrical circuit corresponding to this electromechanical safety chain is closed if the boiler is operating normally and is opened if there is any anomaly in the operation of the boiler. It is known in the art, in this kind of safety device, to add to the electromechanical safety chain a so-called logic safety chain operating in parallel and in a manner that is redundant with respect to the electromechanical safety chain if automatic control and regulation of the boiler become complex and necessitate the use of an industrial programmable automatic controller. The logic safety chain generally consists of a data processing circuit, such as a microprocessor, which receives as input electrical signals produced by the sensors and converted into logic signals at 5 volts, and which feeds the electrical power supply circuit of the actuators via a transistor controlling a relay. The output of the data processing circuit is wired in series in the electromechanical safety chain that constitutes the main safety chain, for example.

Standards require periodic verification that the safety sensors and their associated relay are operating correctly. This requirement leads to the installation of extensive facilities that are generally provided partly in the form of hardwired relay circuits for everything that relates directly to safety and partly in the form of a microprocessor-based system for everything that relates to the procedures and to monitoring them. When two redundant safety chains are provided, the second (logic) safety chain is generally implemented in the microprocessor-based system, but the latter system must be independent of and separate from any boiler control and automation equipment. Consequently, the measures to be taken at present and installed are increasingly extensive and complicated, with relays, dedicated units, wiring, microprocessor-based systems communicating only via wired electrical contacts. Additionally, there is the risk of an operative interfering with the hardwired logic of the electromechanical safety chain when verifying correct operation of the safety sensors, to the extent of jamming a relay in the closed position, which very seriously compromises safe operation of the boiler.

Moreover, the French standard NF D36504 more particularly specifies (see section 4.2) that the operational reliability of a logic safety chain must be evaluated by a specific test procedure that injects errors directly into the equipment to simulate an internal fault, namely failure of all the memory bits taken one by one. A test of this kind takes a particularly long time to execute and adds considerably to the tests that precede the commissioning of this kind of boiler and increase costs commensurately.

The object of the invention is to remedy these drawbacks.

SUMMARY OF THE INVENTION

To this end, the invention consists in a safety device for an industrial boiler, the device comprising electromechanical relays connected to form an electromechanical safety chain, and the device being characterized in that the relays are mounted on a support in the form of a printed circuit card. With this arrangement, the electrical connections between the relays consist of printed circuit tracks, with the result that it is no longer possible for an operative to modify the operating logic of the electromechanical safety chain. The relays are preferably soldered directly to a printed circuit card and the input/output connections to the cards are effected by means of plug-in terminal blocks equipped with a polarizer device. The printed circuit cards can be mounted in a compact and possibly sealed unit so that it is impossible for an operative to obtain access to any of the electromechanical safety chain.

In one particular embodiment of the safety device according to the invention, current converters associated with respective relays of the electromechanical safety chain are provided for converting an input electrical signal of a relay into an electronic signal, the electronic signals supplied by the converters being processed in a logic integrating circuit constituting with the converters an electronic safety chain that is redundant with respect to the electromechanical safety chain. An electronic safety chain of this kind satisfies the requirements of the French standard NF D36504 in that it is possible to evaluate reliable operation of the electronic system at the design stage, and an electronic system is simpler to validate by means of tests than a logic safety chain. The logic integrated circuit is preferably a programmable circuit of the PAL type.

According to another particular embodiment of the safety device according to the invention, to obtain a compact implementation of the safety device, a relay and the current converter associated with the relay are mounted on the same printed circuit card.

According to a further particular embodiment of the safety device according to the invention, each current converter is an optocoupler and thereby electrically isolates the electromechanical and electronic safety chains. In this way, an electrical fault in the electromechanical safety chain has no impact on the operation of the electronic safety chain.

In a further particular embodiment of the safety device according to the invention, the electronic signals are converted into logic signals by means of microcontrollers in order to be sent to a logic safety chain that is redundant with respect to the electronic safety chain, which makes the safety device safer without increasing the complexity of its implementation, since the logic safety chain, constituting a third safety chain, is no longer subject to the test procedures described above and specified in the French standard NF D36504.

The invention is described in more detail next with reference to the appended drawings, which show one embodiment of the invention by way of nonlimiting example.

DETAILED DESCRIPTION OF THE EXEMPLARY EMBODIMENTS

Figure 1:
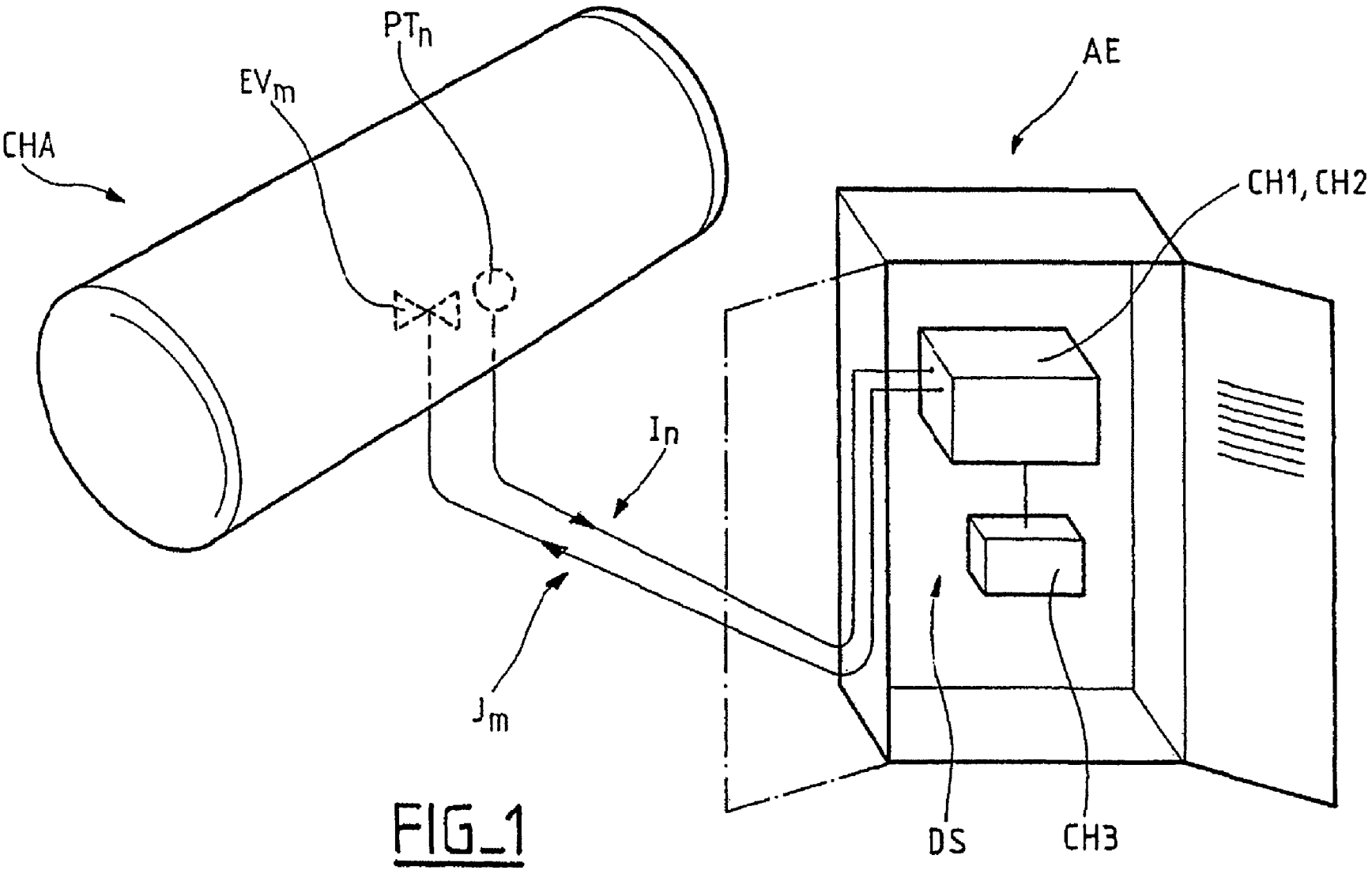
FIG. 1 is a highly diagrammatic representation of the invention.

As shown in FIG. 1, the device according to the invention is connected to at least one sensor $PT_n$ and to at least one actuator $EV_m$ that are generally mounted on an industrial boiler CHA. The sensor $PT_n$, which in this example is a pressure-sensitive switch, sends an electrical current $I_n$ to a safety device DS, which in this example is mounted in an electrical equipment cabinet AE. If it receives the current $I_n$, the safety device returns a second electrical current $J_m$ to the actuator $EV_m$, which in this example is a solenoid valve, to maintain the actuator in a normal operating position. If the current $I_n$ is not received, the safety device DS commands a relay (not shown) to open the electrical power supply circuit of the actuator EV, which cancels the current $J_m$ and thereby triggers shutting down of the boiler. The electrical currents $I_n$ and $J_m$ are generally high alternating currents at 230 volts. According to the invention, the safety device DS comprises a unit containing printed circuit cards, referred to hereinafter as printed circuits, that form an electromechanical safety chain CH1. The unit comprises one or more printed circuits on which the relays forming the first safety chain CH1 are mounted, with the result that these relays are not interconnected by hardwired logic but instead by printed circuit conductive tracks. These circuits can thereby form a compact assembly enclosed in a unit, which may be sealed, to prevent an operative modifying their configuration.

Figure 3:
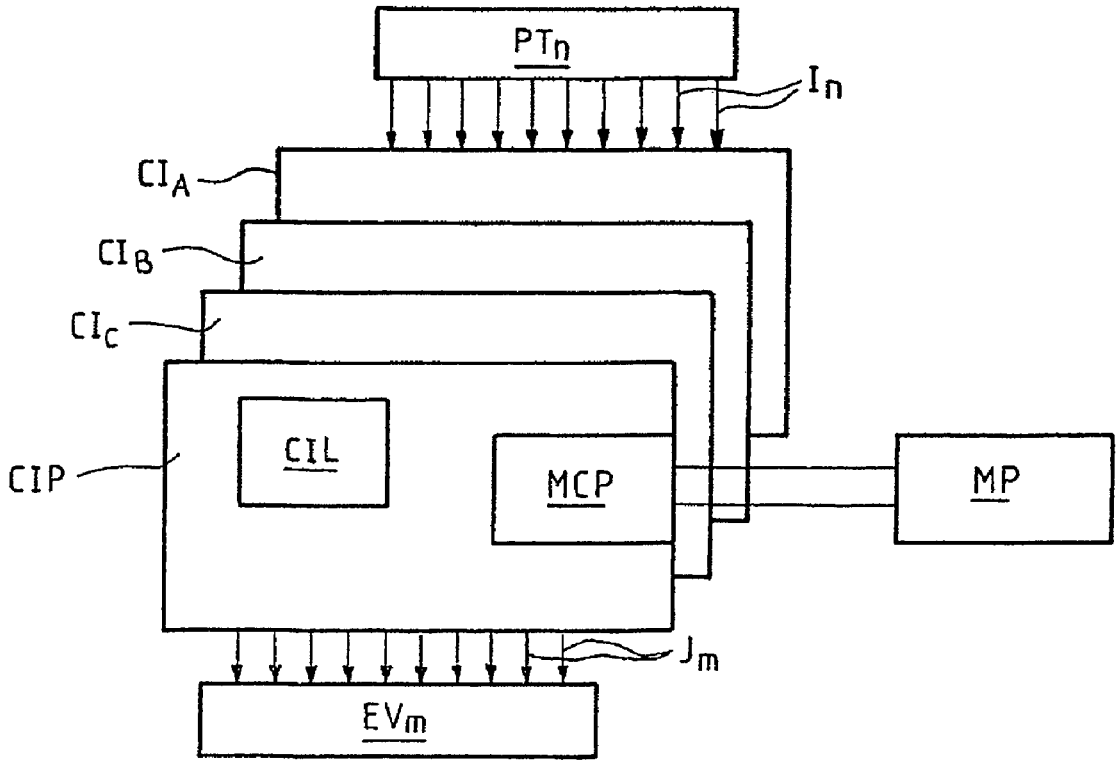
FIG. 3 is a highly diagrammatic representation of the arrangement of the printed circuits of the device according to the invention.

This kind of boiler generally comprises a plurality of sensors associated with a plurality of actuators, and the unit can contain a plurality of printed circuits $CI_A$, $CI_B$, $CI_C$, for example, for managing the various sensors on the boiler, as shown in FIG. 3. These circuits are advantageously plugged into connectors on a backplane card (not shown) that is also equipped with connectors providing the electrical connections to the sensors and to the actuators.

Figure 2:
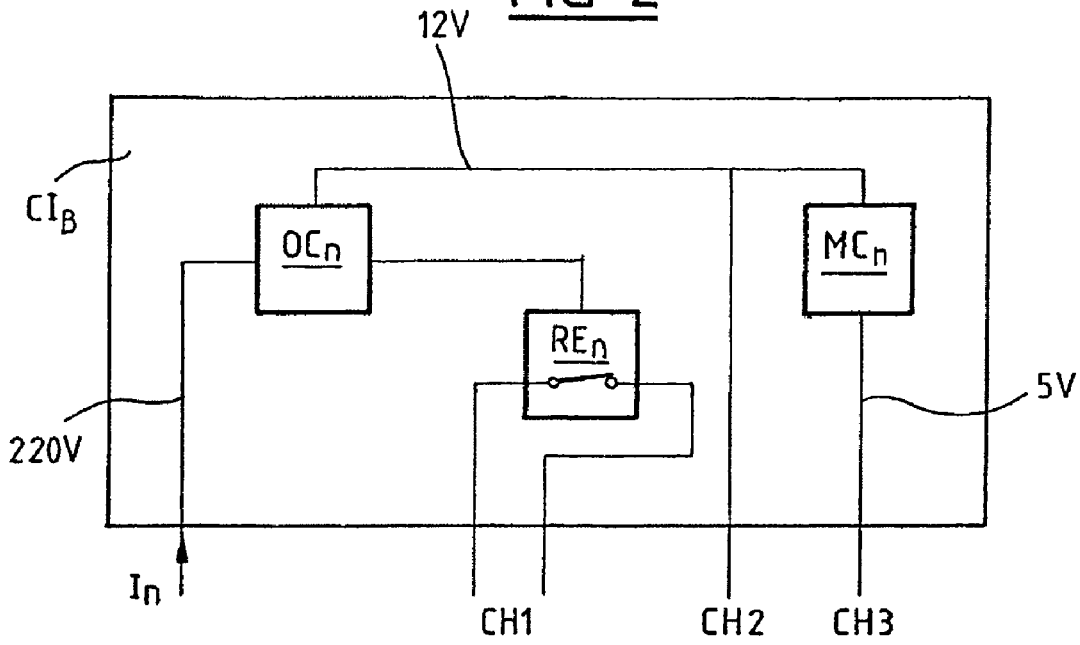
FIG. 2 is a highly diagrammatic representation of a printed circuit of the safety device according to the invention.

FIG. 2 shows the printed circuit $CI_B$ but the circuits $CI_A$, $CI_B$ [sic], $CI_C$ are analogous to the circuit $CI_B$. As shown in this figure, each printed circuit $CI_A$, $CI_B$, $CI_C$ comprises a relay $RE_n$ that remains closed if it receives a current $I_n$ from the corresponding sensor $PT_n$ and thereby closes the conventional electromechanical safety chain CH1. More particularly, the circuits $CI_A$, $CI_B$, $CI_C$ have their outputs connected to a main circuit CIP seen in FIG. 3 that comprises the connections forming the first safety chain CH1. This main circuit is also mounted on the backplane card. For example, it connects in series the relays $RE_n$ of each printed circuit $CI_A$, $CI_B$, $CI_C$, and controls a relay for opening the electrical power supply circuit of the actuator or the actuators of the boiler as soon as one of the relays $RE_n$ is opened.

Alternatively, the safety device can include a second safety chain CH2 that is redundant with respect to the first safety chain, the second safety chain being an electronic chain that is also capable of opening the electrical power supply circuit of the actuator $EV_m$ to interrupt its electrical power supply if an electrical current $I_n$ is not received. The advantage of controlling the second chain electronically is that the validation tests are simpler than in the context of computerized management. The electronic chain CH2 can be in a separate unit and connected to the backplane card by dedicated connectors. However, it can advantageously be integrated into the printed circuits that define the electromechanical chain, as explained hereinafter.

In this variant, the current $I_n$ supplied by a sensor $PT_n$ is converted into an electronic signal by a corresponding converter $OC_n$ on the printed circuit on which the corresponding relay $RE_n$ is mounted. The electronic signal is a direct current at 12 volts received by a logic integrated circuit CIL to form the second safety chain CH2. The logic integrated circuit CIL can be mounted on the main printed circuit CIP of the safety device DS, the main circuit being itself connected to the backplane card. Accordingly, the main printed circuit CIP receives the electronic signals produced by each printed circuit $CI_A$, $CI_B$, $CI_C$ to command a relay to open the electrical power supply circuit of the actuator $EV_m$ on the instructions of the logic integrated circuit CIL.

A logic integrated circuit of the above kind is advantageously implemented with a circuit of the PAL type, for example. PAL circuits operate at 12 volts and provide logic operators between input channels and output channels at very low cost. They are configured permanently by electrically "burning" them.

FIG. 2 shows a printed circuit $CI_A$, $CI_B$, $CI_C$, or electronic card as it is otherwise known, receiving the current $I_n$ from a single sensor. However, the same card can receive the currents $I_n$ supplied by a plurality of sensors, to manage all of the sensors of a subsystem of the boiler, for example the burner. In this kind of configuration, the card comprises a relay and an optocoupler for each sensor, the relays being connected in series on the card to provide a single output for the electromechanical safety chain CH1. The electronic signals from the optocouplers are then combined via a local logic integrated circuit that is also mounted on the card $CI_A$, $CI_B$, $CI_C$. That circuit therefore sends the electronic safety chain CH2 a single electronic output signal reflecting the state of the unit concerned.

Alternatively, the safety device according to the invention can also comprise a third safety chain CH3 that is redundant with respect to the other safety chains CH1 and CH2, the third chain being of the logic type. In this case, each printed circuit CI includes a microcontroller that converts the electronic signal at 12 volts into a logic signal timed by a clock in the microcontroller. This logic signal is output at a voltage of approximately 5 volts. As in the case of the other safety chains, the logic signals are collected by the main printed circuit CIP, which is equipped with a microcontroller that combines the data processing signals and communicates with a microprocessor MP to form the third safety chain. More particularly, the microprocessor MP also communicates with the microcontroller MCP to trigger shutting down of the boiler on the instructions of the management logic program of the third chain. The microprocessor then opens the relay for opening the power supply circuit of the actuator or actuators $EV_m$ via a transistor that is mounted on the main printed circuit. A supplementary advantage of the invention is that this logic safety chain constitutes a third chain and is therefore no longer subject to the test specifications of the French standard NF D36504 referred to above.

In the case of the printed circuit CI connecting together a plurality of sensors of the same subsystem of the boiler, the microcontroller MC of the printed circuit can be a parallel-serial converter. This kind of converter receives as input the 12 volt electronic signals from each sensor and supplies as output a clocked serial logic signal at 5 volts reflecting the state of each of the sensors managed by the circuit $CI_A$, $CI_B$, $CI_C$. In this way, the microcontroller MCP of the main printed circuit is able to communicate to the microprocessor MP logic data defining the precise state of each sensor of the boiler.

It is clear that the safety device according to the invention with heterogeneous redundancy is more compact and safer since an operative cannot modify its configuration. Moreover, the provision of a third safety chain in the form of a logic safety chain enables connection of the boiler to an information system providing a precise indication of the state of each sensor of the boiler.

The invention claimed is:

1. A safety device for an industrial boiler, the device comprising:

at least one electromechanical relay which forms an electromechanical safety chain, wherein each electromechanical relay of the at least one electromechanical relay is mounted on a support in the form of a printed circuit card; and a current converter associated with a first electromechanical relay of the at least one electromechanical relay of the electromechanical safety chain, which converts an input electrical signal of the first electromechanical relay into an electronic signal, the electronic signal supplied by the current converter being processed in a logic integrated circuit, wherein the current converter and the logic integrated circuit operate as an electronic safety chain that is redundant with respect to the electromechanical safety chain, wherein the safety device is connected to at least one sensor and to at least one actuator which are mounted on the industrial boiler, and the at least one sensor delivers an electrical current as a corresponding input signal to the electromechanical safety chain, and the safety device controls the at least one actuator depending on electrical current delivered by the sensor.

2. A device according to claim 1, wherein the first electromechanical relay and the current converter associated with the first electromechanical relay are mounted on the same printed circuit card.

3. The safety device according to claim 1, wherein the current converter is an optocoupler.

4. The safety device according to claim 1, wherein said logic integrated circuit is a programmable array logic programmable circuit.

5. The safety device according to claim 1, wherein the electrical signal is converted by microcontrollers in order to be sent to a logic safety chain that is redundant with respect to the electronic safety chain.

* * * * *